United States Patent [19]

Hammelmann

[11] 4,274,590

[45] Jun. 23, 1981

[54] APPARATUS FOR TREATING UPRIGHT SURFACES

[76] Inventor: Paul Hammelmann, Zum Sundern 17, 4740 Oelde 1, Fed. Rep. of Germany

[21] Appl. No.: 92,943

[22] Filed: Nov. 9, 1979

[30] Foreign Application Priority Data

Nov. 11, 1978 [DE] Fed. Rep. of Germany ..... 2849040

[51] Int. Cl.[3] ..... B05B 3/18

[52] U.S. Cl. ..... 239/185; 414/735

[58] Field of Search ..... 239/178, 184, 185, 100, 239/159, 160, 164; 414/749, 750, 680, 735, 743

[56] References Cited

U.S. PATENT DOCUMENTS

| | | | |
|---|---|---|---|
| 3,262,593 | 7/1966 | Hainer | 414/751 X |
| 3,833,175 | 9/1974 | Pulk | 239/178 X |

*Primary Examiner*—Richard A. Schacher

*Attorney, Agent, or Firm*—Michael J. Striker

[57] ABSTRACT

A device for cleaning and/or corrosion-protecting upright surfaces of ship's hull, oil tanks and the like has a carriage movable along the surface and an outrigger arm extending towards the surface. The front end of the arm carries a beam, a horizontal leg of which carries a pivot bearing having an upright axes. A U-shaped carrier is mounted on the bearing to turn with the same and in turn has one or more working devices mounted in it.

9 Claims, 11 Drawing Figures

APPARATUS FOR TREATING UPRIGHT SURFACES

BACKGROUND OF THE INVENTION

1. Field of the Invention

This invention relates to apparatus for treating upright surfaces, for example ship hulls, silo walls, oil storage tanks and the like, with cleansers (e.g., detergent, sandblast sprays) and conserving materials (e.g., paint).

2. The Prior Art

Structures of the type mentioned above are usually made of steel and their surfaces are therefore subject to damage from corrosion. To prevent this, these surfaces are coated with corrosion-preventing media—such as paint or the like—which protect them. Before this can be done, however, the surfaces must be thoroughly cleaned—e.g., by washing, sandblasting or in other ways—because otherwise the corrosion-protecting media are not able to properly fulfill their intended purpose.

To manually effect such cleaning and later to apply the corrosion-protecting media, is extremely time-consuming, labor-intensive and hence costly. Equipment has therefore been developed for this purpose.

These devices have a carriage which travels horizontally along a support extending along the surface to be cleaned; for example, in the case of a ship hull the carriage travels along the upper edge of the dock wall where the hull is berthed. An outrigger arm projects laterally from the carriage and is turnable relative thereto about a vertical axis. Projecting from the outrigger and turnable relative to the same about a vertical and a horizontal axis, is a mast which carries at its free end an L-shaped support or which working devices, e.g., spray equipment, sand or grit-blasting equipment or the like, are directly mounted. This has been found not to be entirely satisfactory, because the equipment tends to shift out of its selected position and the transmission of forces during movement about the respective horizontal and vertical axes, is not favorable.

SUMMARY OF THE INVENTION

Accordingly, it is an object of the invention to avoid the disadvantages of the prior art.

A more particular object of the invention is to provide an apparatus of the type in question, wherein the device is multi-dimensionally adjustable and the force transmissions discussed above are particularly favorable.

Another object of the invention is to provide an apparatus of the kind under the discussion, wherein the once-selected position of the working device relative to the surface to be cleaned, is maintained unchanged.

In keeping with these objects, and still others which will become apparent hereafter, one aspect of the invention resides in an apparatus for treating upright surfaces. Briefly stated, the apparatus may comprise a carriage movable horizontally along a support; an outrigger projecting from said carriage and being tiltable relative to the carriage about a vertical and a horizontal axis, the outrigger having a free end portion; an L-shaped support connected to said free end portion and having a generally horizontal leg; a pivot bearing having a lower part immovably connected to said leg, and an upper part turnable about an upright axis relative to said lower arm; a U-shaped carrier connected to and turnable with said upper part and having transversely spaced arms; and a surface-treating working device mounted on said carrier and located between said arms thereof.

According to a particularly advantageous embodiment of the invention the pivot axis of the bearing coincides with the center plane of the U-shaped carrier which extends parallel to the two arms of the U midway therebetween. In the region of the free ends of the arms a turnable shaft is mounted on the carrier and supports the respective working device; the center of gravity of the working device preferably is located on the turning axis of the shaft. An important advantage of this is that the transmission of force from the working device to the L-shaped support takes place via the pivot axis of the bearing midway between the arms of the U-shaped carrier. This assures, to the maximum extent possible, the suppression of oscillations on the part of the working device, as well as reliable maintenance of the working device in its selected position relative to the surface to be treated. Particularly if the working device—which is interchangeable against others—is a grit-blasting device or a high-pressure water spraying device, this arrangement assures an excellent cleaning effect which is, of course, the basis for a uniform deposition and lasting adhesion of the subsequently applied anti-corrosion medium, such as paint or the like.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
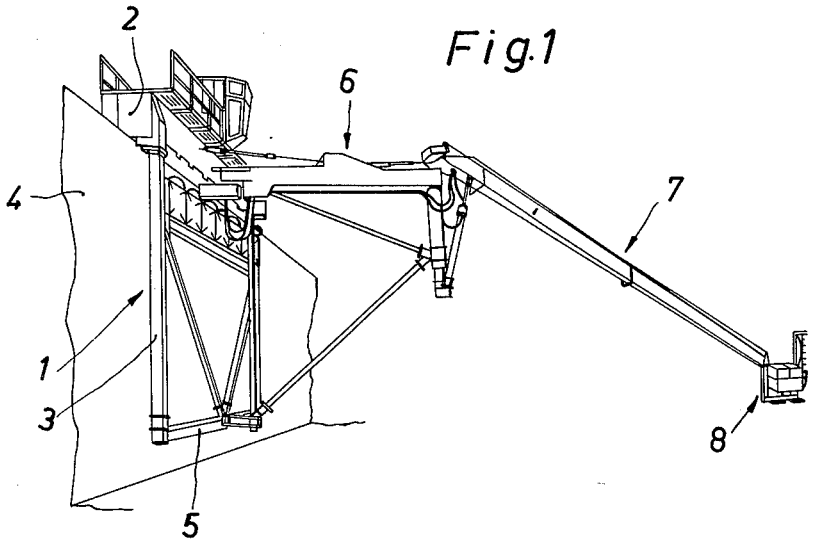
FIG. 1 is a somewhat simplified perspective view, illustrating an apparatus according to the invention.
Figure 4:
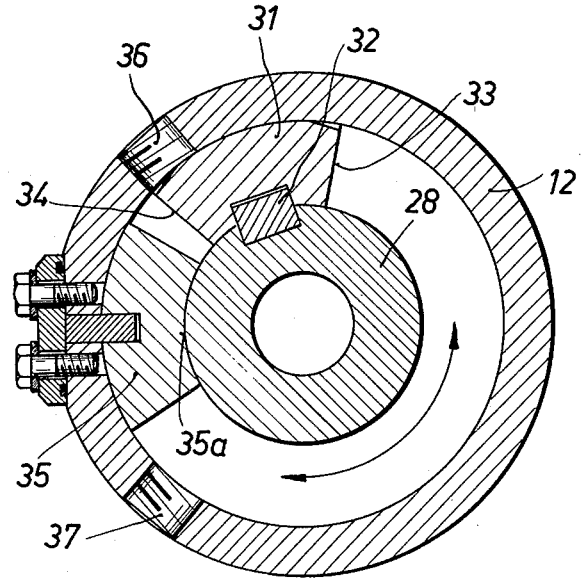
FIG. 4 is a section on line IV—IV in FIG. 3.
Figure 2:
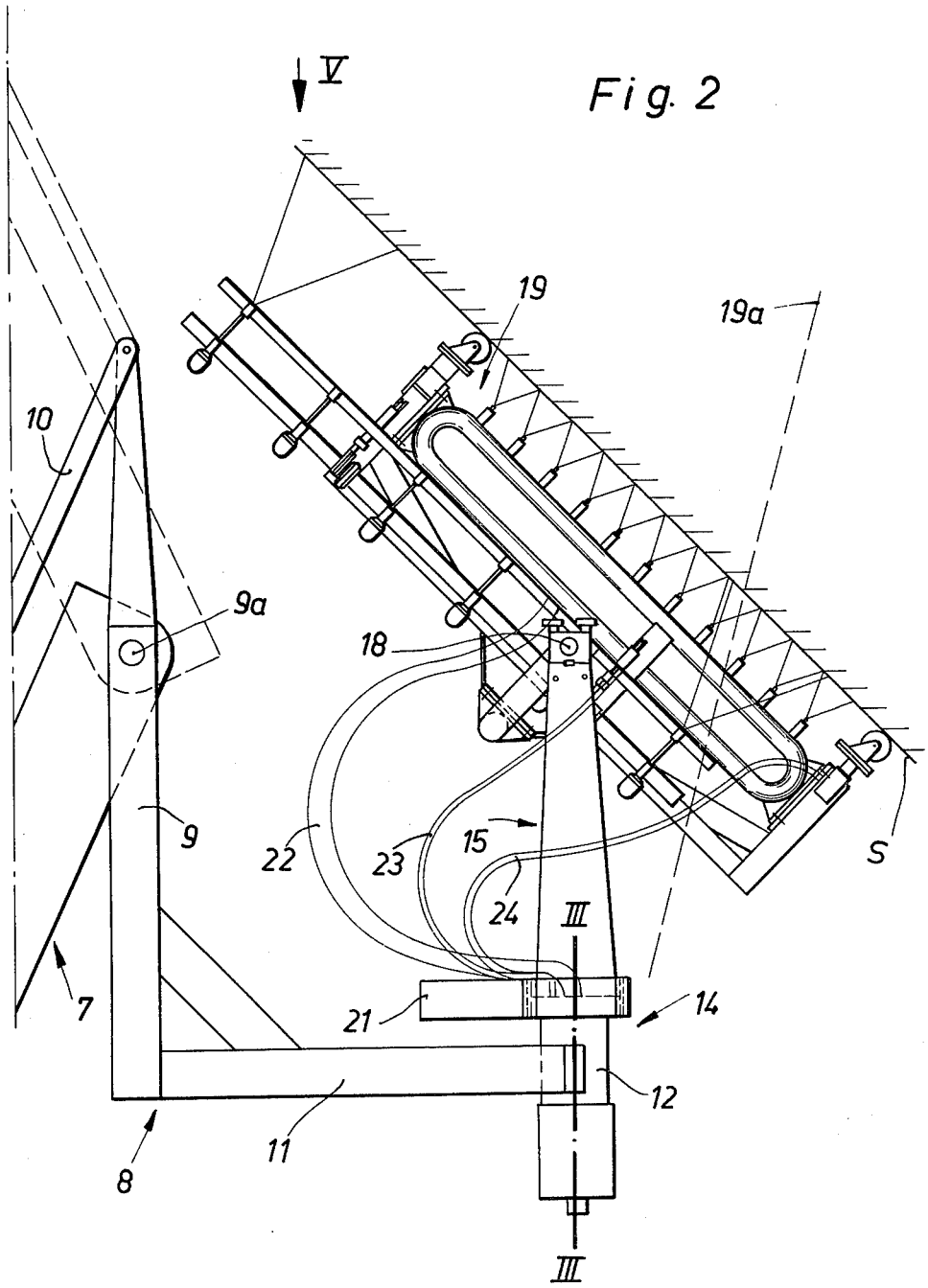
FIG. 2 is a side view, showing the front part of the outrigger of the apparatus in FIG. 1, provided with a high-velocity waterspraying device.
Figure 3:
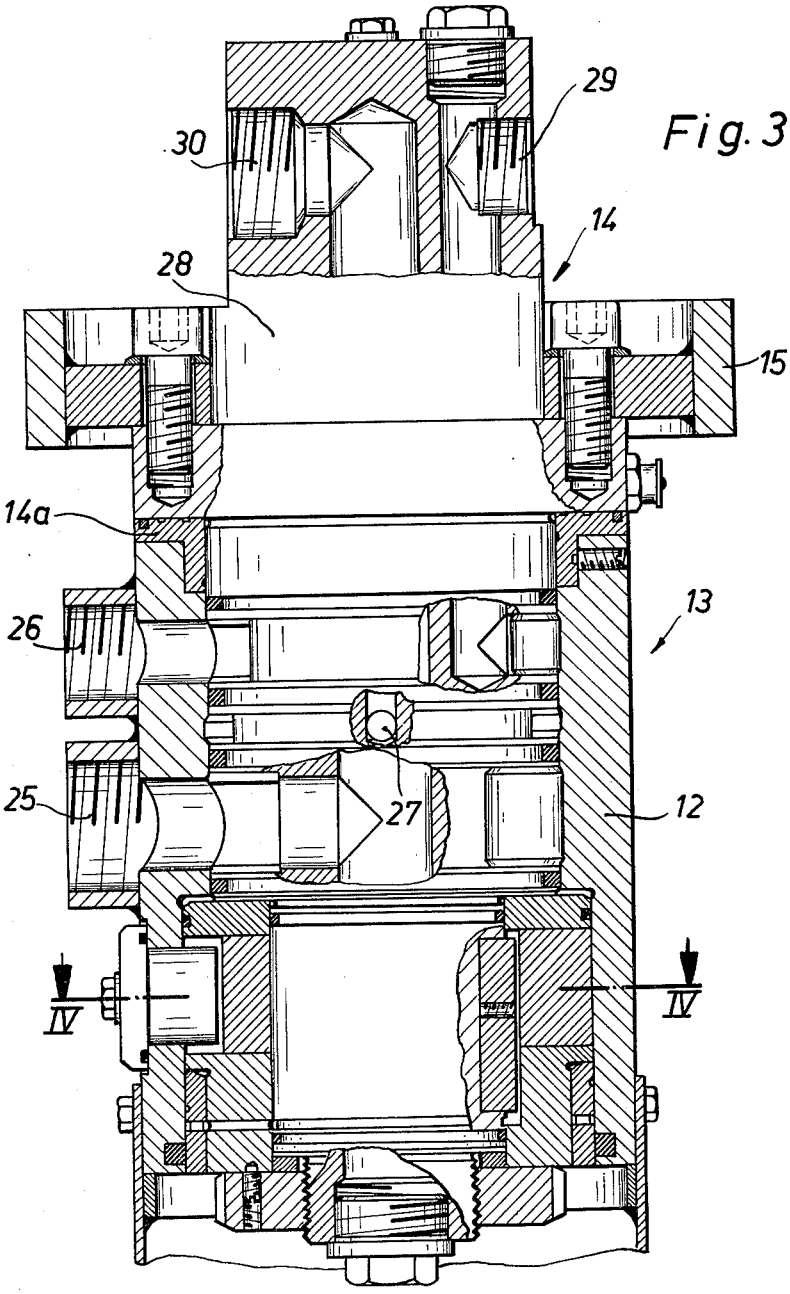
FIG. 3 is a section on line III—III of FIG. 2.
Figure 5:
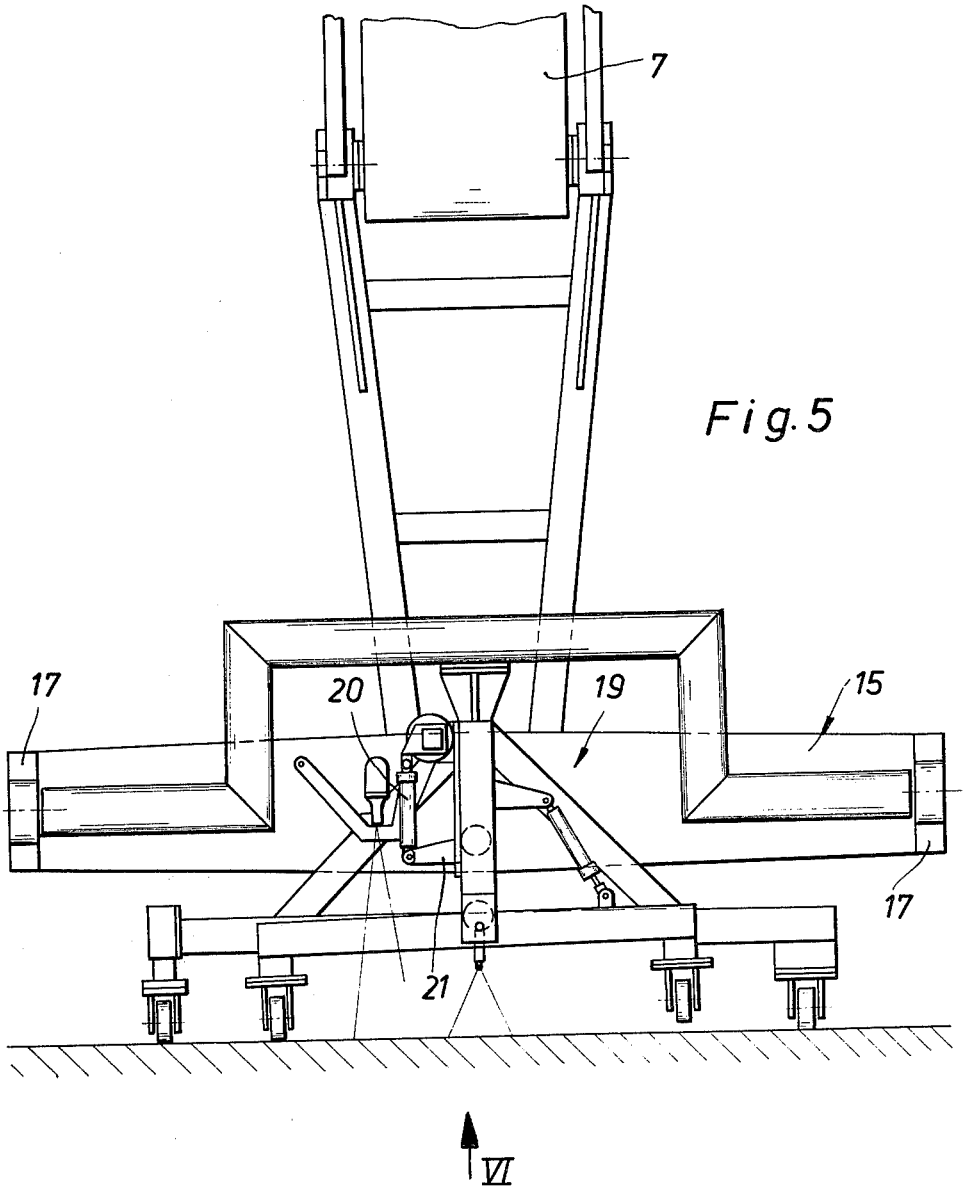
FIG. 5 is a view as seen in the direction of arrow V in FIG. 2.

A first embodiment of the invention is illustrated in FIGS. 1–7, in form of an apparatus which is mountable on a rail extending along the top edge of a dock 4 in which a ship (not shown) is berthed. Of course, if the apparatus is used to treat other upright surfaces, e.g., of silos, a support other than the dock 4 must be provided.

In any case, the apparatus has a carriage 1 which in vertical section is substantially L-shaped and which includes an upper horizontal part 2 movable along the aforementioned rail of the dock wall 4, and a vertical part 3 which depends from the part 3 so as to move parallel to the wall 4 adjacent the same. Part 3 is a preferably a frame construction so as to be strong but light. The lower frame member 5 of part 3 is provided with rollers (not shown) which rest on and move along, a further rail (not shown) secured to the wall 4 at the appropriate level.

An outrigger of the apparatus includes an arm 6 which is mounted on the carriage 1 so as to be pivotable relative thereto about a vertical axis; in the illustrated embodiment the arm 6 is of frame-shaped construction and of trapezoidal outline. A mast 7 of the outrigger is pivoted to the arm 6 so that it can turn relative to the same about a vertical as well as about a horizontal axis. The free front end of the mast 7 carries a support beam 8 of L-shaped cross-section. The vertical leg 9 of the beam 8 is pivoted to the mast 7 at 9*a* (FIG. 2) and a suitable device—here illustrated as a parallel linkage 10—is provided (see FIG. 2) to effect tilting about the axis 9*a*.

The construction as described thus far is known per se from the prior art.

Unlike the prior art, however, the apparatus according to the invention does not mount the working devices (e.g., in FIGS. 1–7 the spray unit 19) directly on the support beam 8.

Figure 6:
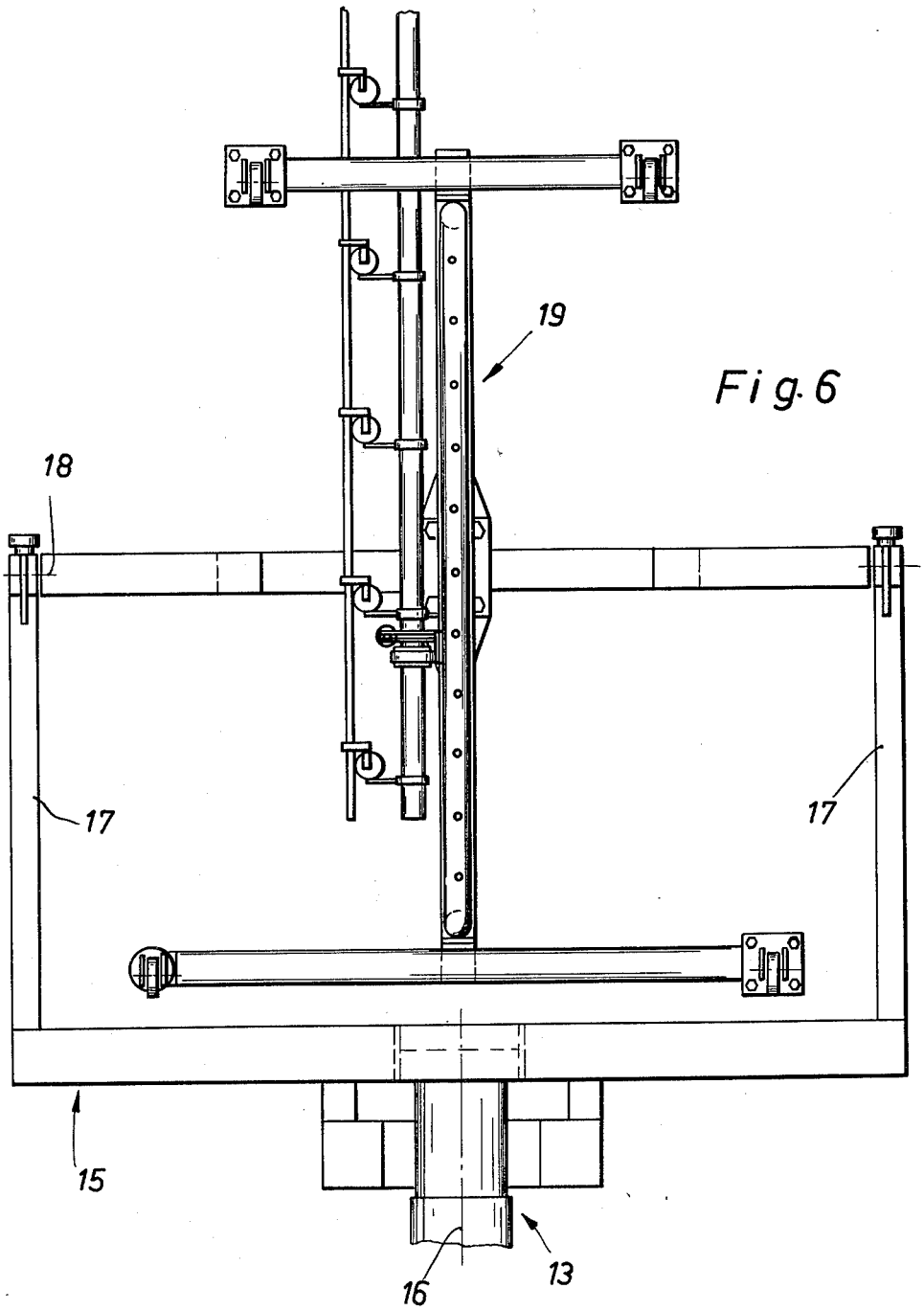
FIG. 6 is a view as seen in direction of the arrow VI in FIG. 5.
Figure 7:
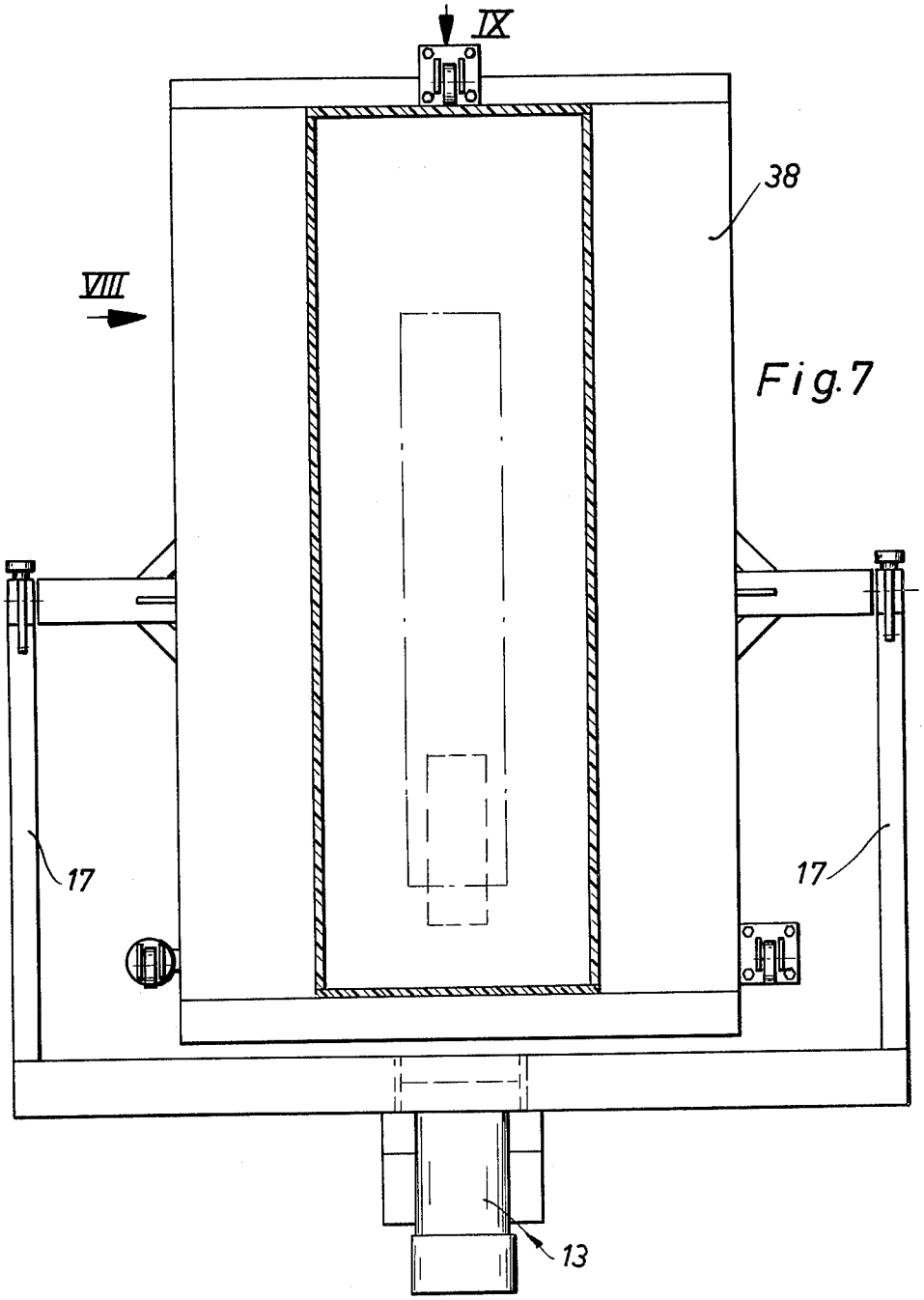
FIG. 7 is a view similar to FIG. 6, but showing the front end of the outrigger carrying a grit-blasting working device.

Instead, the horizontal leg 11 of the support beam 8 has mounted on it a pivot bearing 13 (FIG. 3) the lower part 12 of which is fixedly (i.e., immovably) connected to the leg 11. The upper part 14 of the bearing 13 is connected with the lower part 12 via a shaft 18 and is turnably supported on an angular cross-section ring 14*a* of part 12. A U-shaped carrier 15 is mounted on the upper part 14 for rotation with the same; the mounting being such that the axis of rotation 16 of the upper part 14 coincides with the vertical plane of symmetry of the carrier 15, which is to say that it extends midway between and parallel to the arms 17 of carrier 15 (FIG. 6).

A shaft 18 is mounted in the free end portions of the arms 17 and serves to pivotally mount a working device, in the illustrated embodiment the unit 19 which is provided with a plurality of nozzles from which fluid (e.g., water) is discharged at high speed and pressure against a surface S (FIG. 2) to be treated. The unit 19 is tiltable about shaft 18 between the solid-line end position shown in FIG. 2 and a second end position symbolically indicated by the chain line 19*a*. A particularly advantageous concept of the invention provides for the respective working device (i.e., here the unit 19) to be so mounted in the carrier 15 that its center of gravity coincides with (i.e., is located on) the longitudinal central axis of shaft 18. This greatly simplifies tilting of the device 19 about the axis defined by shaft 18, because no imbalanced masses need by controlled. The tilting itself can be effected with the acid of a cylinder-and-piston unit 20 (FIG. 5) which has one end articulated to the device 19 and its other end articulated to a rigid extension of the upper part 14 of bearing 13.

Supply lines (e.g., flexible hoses) 22, 23 and 24 for different elements of the device 19 are connected to the turnable upper bearing part 14. The working media to be forwarded by these lines to the device 19 or supplied to the stationary lower bearing part 12, and more particularly to its ports 25, 26 and 27 for pressurized water, pressurized oil and compressed air, respectively. From these inlet ports 25–27 the respective media flow via channels (not shown) in the central shaft 28 to the outlet ports provided in part 14 (only ports 29 for the pressurized oil and 30 for pressurized water are visible in FIG. 3). The supply lines 22–24 are connected to these respective outlet ports.

The shaft 28 defines with the stationary circumferential wall of the lower bearing part an annular chamber. Located in this chamber is a rotary piston 31 (FIG. 4) which is connected to shaft 28 via a key 32 or other suitable means so as to move in the chamber when shaft 28 rotates. To subdivide the chamber in two control compartments for the piston 31, a segment-shaped member 35 is located in the chamber and secured to the circumferential wall of part 12; its radially inner face 35*a* is shaped to sealingly engage the surface of shaft 28 but not to prevent turning of the same. The circumferential wall is also provided with two ports 36, 37 which are located at opposite sides of the member 35, as considered in the circumferential direction of the annular chamber. Hydraulic fluid is admitted and removed through these ports 36, 37; i.e., each port is both an inlet port and an outlet port. When hydraulic fluid is admitted into the chamber it will cause the piston 31 (and hence the shaft 28) to rotate in clockwise or anticlockwise direction (FIG. 4), depending upon whether the fluid acts upon the pressure face 33 or 34 of the piston. After the shaft 28—and therefore the device 19—has reached its desired position, the ports 36, 37 may be connected to one another by a suitable conduit and valving (not shown), so that during operation of the apparatus a fluid-damped rotary movement of the device 19 is possible about the axis defined by shaft 28.

Figure 8:
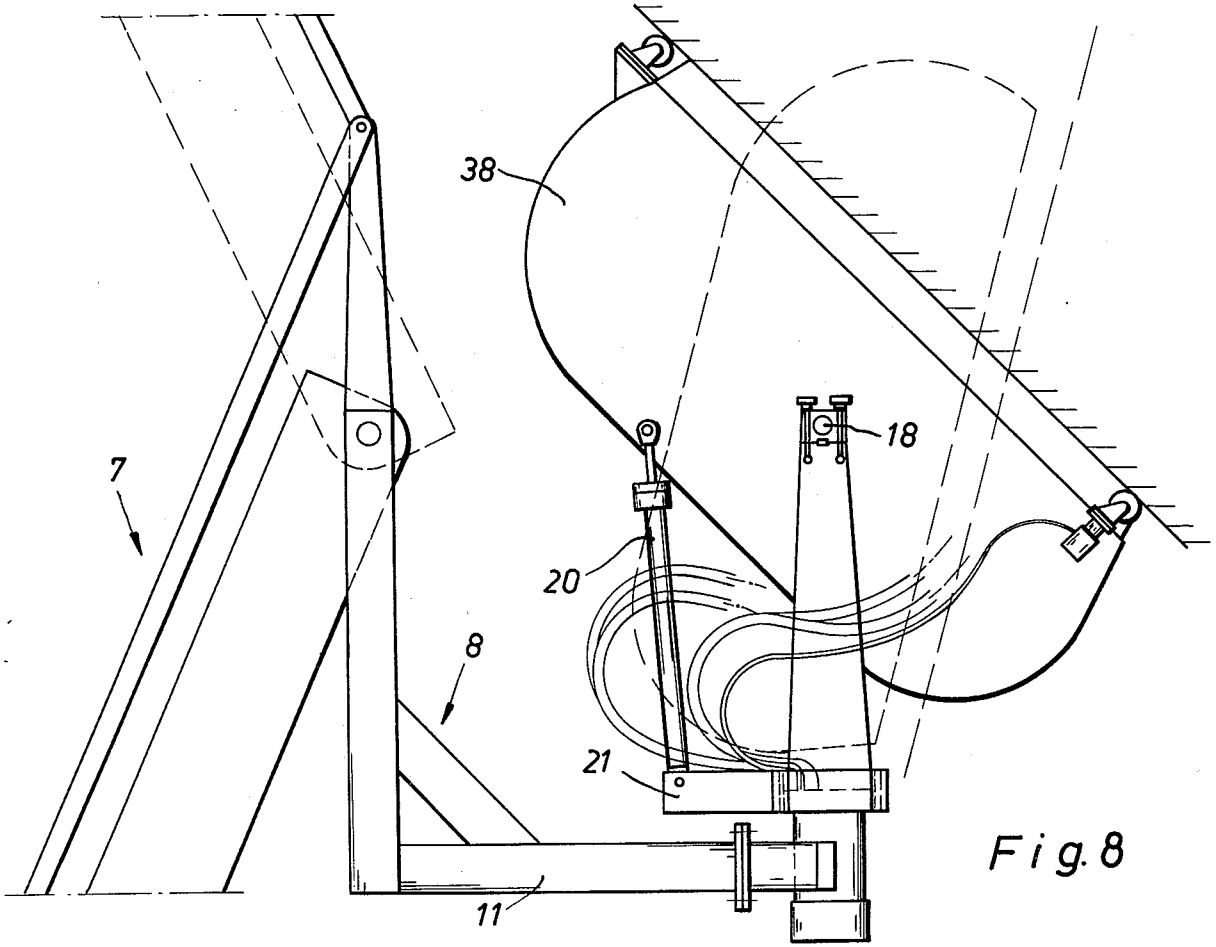
FIG. 8 is a view as seen in direction of the arrow VIII in FIG. 7.
Figure 9:
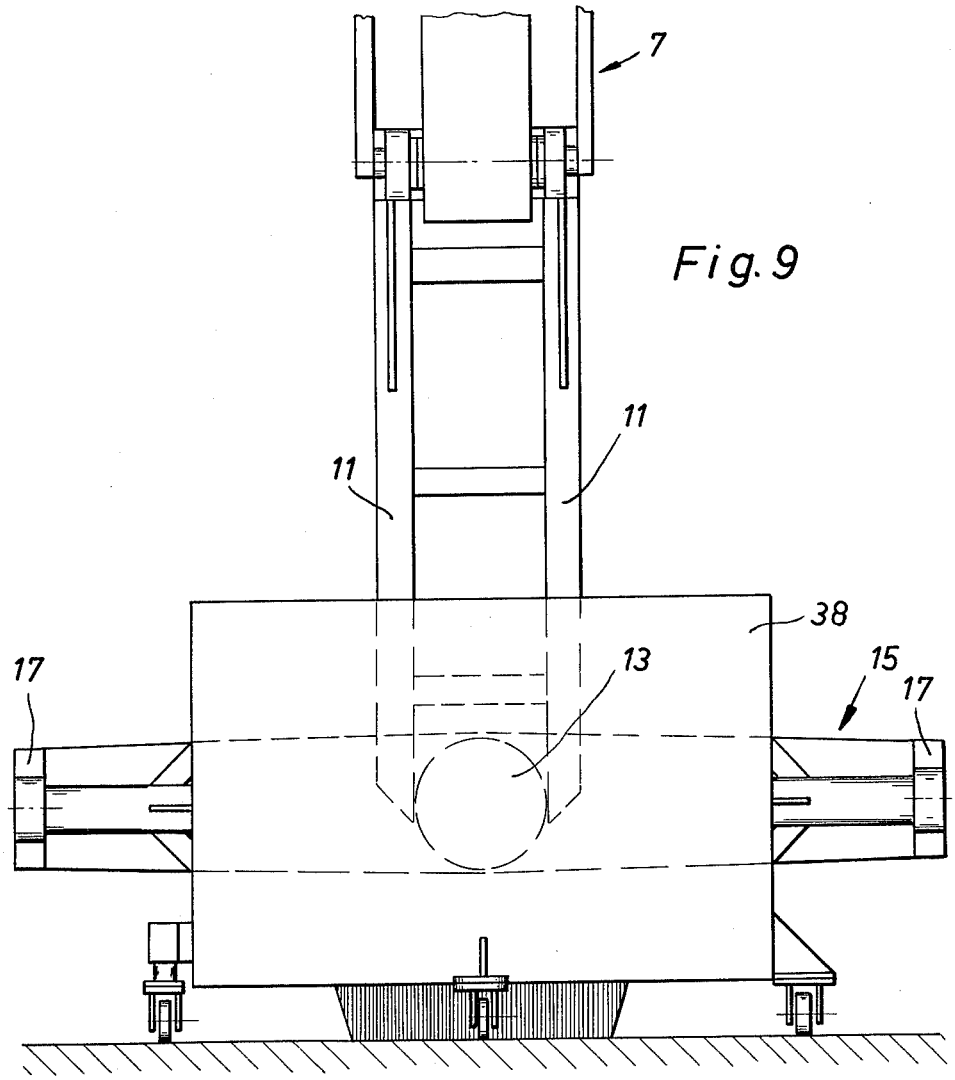
FIG. 9 is a view as seen in direction of the arrow IX in FIG. 7.

The embodiment in FIGS. 8 and 9 is identical in all but the aspects explained below, to the embodiment in FIGS. 1–7. Therefore, the same reference numerals have been used to identify like elements. However, in FIGS. 8 and 9 the working device 19 is replaced with a grit-blasting device 38. This is again mounted on shaft 18 and connected to the cylinder-on-piston unit 20 for tilting about that shaft. The device 38 can be tilted through an angular range defined by the solid-line and broken-line end positions shown in FIG. 8.

Figure 10:
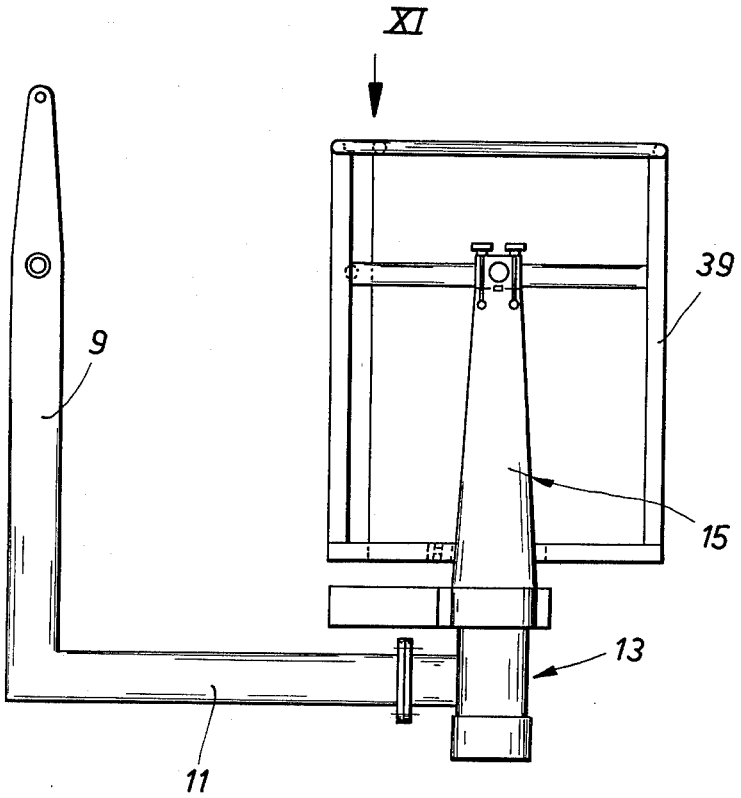
FIG. 10 is a side view, showing the front end of the apparatus provided with a personnel bucket.
Figure 11:
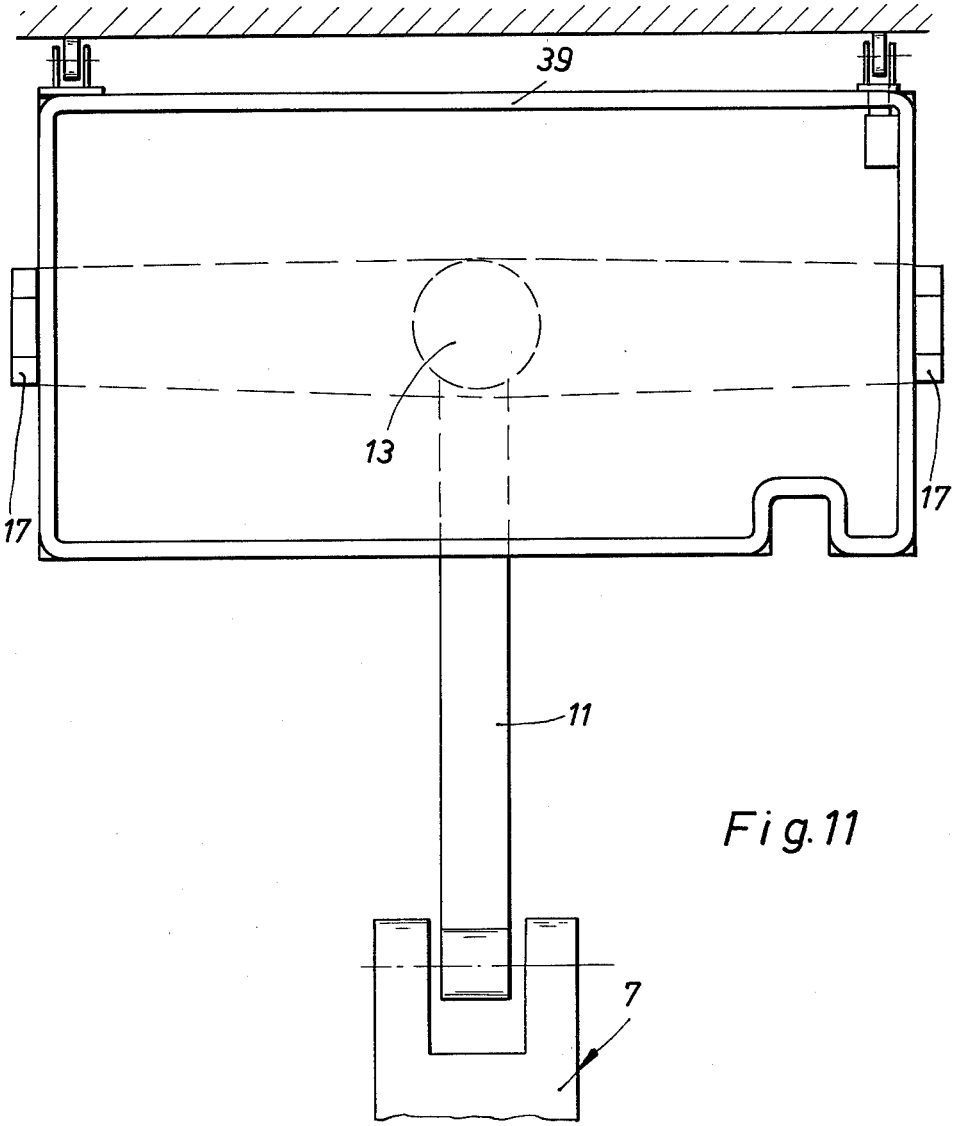
FIG. 11 is a view of FIG. 10, as seen in the direction of the arrow XI.

Finally, FIGS. 10 and 11—wherein again like reference numerals identify like elements as in FIGS. 1–7—differ from that embodiment in that the working device installed in the U-shaped carrier is a personnel basket or bucket 39, i.e., a receptacle in which one or more persons can stand to inspect the surface to be treated for a close-up view and/or to perform e.g., manual work on the surface.

While the invention has been illustrated and described as embodied in a device for treating upright surfaces, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Apparatus for treating upright surfaces, particularly ship hulls, comprising a carriage movable horizontally along a support; an outrigger projecting from said carriage and being tiltable relative to the carriage about a vertical and a horizontal axis, said outrigger having a free end portion; an L-shaped support connected to said free end portion and having a generally horizontal leg; a pivot bearing having a lower part immovably connected to said leg, and an upper part turnable about an upright axis relative to said lower arm; a U-shaped carrier connected to and turnable with said upper part and having transversely spaced arms; and a surface-treating working device mounted on said carrier and located between said arms thereof.

2. Apparatus as defined in claim 1, wherein said arms extend parallel to and are equidistantly spaced from, said upright axis.

3. Apparatus as defined in claim 1, said arms having respective free end portions; and further comprising a turnable shaft secured to and connecting said end portions to one another, said working device being pivotable on said shaft so as to be pivotable about the same.

4. Apparatus as defined in claim 1, said arms having respective free end portions; and further comprising a turnable shaft secured to and connecting said end portions to one another, said working device being pivotably mounted on said shaft and having a center of gravity which coincides with the pivot axis defined by the shaft.

5. Apparatus as defined in claim 1, said upper part having a transverse extension; and further comprising a cylinder-and-piston unit having one end articulated to said extension and another end articulated to said working device.

6. Apparatus as defined in claim 1, said lower part defining a circular chamber and including a shaft extending through said chamber on said axis and connected to said upper part; a rotary piston connected to said shaft and located in said chamber, said piston having two circumferentially spaced working faces; and means for applying a pressurized working fluid to respective ones of said faces in dependence upon the direction of rotation desired for said shaft.

7. Apparatus as defined in claim 6, said chamber being bounded by a circumferential wall of said lower part and by a portion of said shaft; and further comprising a segment-shaped member located in said chamber and fixedly connected to said circumferential wall, said member subdividing said chamber and having a radially inner surface in sealing but sliding engagement with said shaft.

8. Apparatus as defined in claim 7; further comprising inlet and outlet ports for pressurized working fluid provided in said circumferential wall and communicating with said chamber at opposite circumferential sides of said member, said parts being connectable with one another when said shaft has reached a desired angular position.

9. Apparatus as defined in claim 1; further comprising inlet ports on said lower part for pressurized water, pressurized oil and compressed air; and corresponding outlet ports provided in said upper part and communicating with said inlet ports, said outlet ports being connectable to corresponding supply ports of the working device.

* * * * *